US005724223A

United States Patent [19]

Feuser et al.

[11] Patent Number: 5,724,223

[45] Date of Patent: Mar. 3, 1998

[54] CONTROL OF A PROPORTIONAL VALVE USING MAINS VOLTAGE

[75] Inventors: Alfred Feuser, Lohr-Rodenbach; Jörg Dantlgraber, Lohr/Main; Helmut Kunkel, Wiesthal; Rudolf Schäffer, Marktheidenfeld, all of Germany

[73] Assignee: Mannesmann Rexroth GmbH, Lohr, Germany

[21] Appl. No.: 406,808

[22] Filed: Mar. 20, 1995

Related U.S. Application Data

[63] Continuation of Ser. No. 7,911, Jan. 22, 1993, abandoned.

[30] Foreign Application Priority Data

Jan. 22, 1992 [DE] Germany ..... 42 01 652.5

[51] Int. Cl.[6] ..... H01F 7/18

[52] U.S. Cl. ..... 361/152; 361/154

[58] Field of Search ..... 361/152–156, 361/139, 143, 160, 166, 170, 187, 206

[56] References Cited

U.S. PATENT DOCUMENTS

| | | | |
|---|---|---|---|
| 4,446,410 | 5/1984 | Yagura et al. | 361/152 |
| 4,631,629 | 12/1986 | Mallick, Jr. | 361/154 |
| 5,191,504 | 3/1993 | Narisawa et al. | 361/186 |

FOREIGN PATENT DOCUMENTS

| | | |
|---|---|---|
| 172712 | 2/1986 | European Pat. Off. . |
| 212462 | 3/1987 | European Pat. Off. . |
| 3003506 | 8/1981 | Germany . |
| 3112280 | 10/1982 | Germany . |
| 3824526 | 1/1990 | Germany . |
| 3927972 | 2/1991 | Germany . |
| 1295458 | 3/1987 | U.S.S.R. . |

OTHER PUBLICATIONS

A Schmitt, "The Hydraulic Trainer", Mannesman Rexroth GmbH, Nov. 1981, pp. 143–148.

W. Schmidt and O. Feuste "Optoelektronik–Kurz und bündig", Vogel–Verlag 1975, pp. 164 and 165.

*Primary Examiner*—Fritz Fleming

*Attorney, Agent, or Firm*—Cushman, Darby & Cushman IP Group of Pillsbury, Madison & Sutro LLP

[57] ABSTRACT

A proportional valve has an output proportional to an electrical input signal. In a preferred embodiment, the valve is actuated by a proportional solenoid having a coil which is controlled by a control signal in proportion to voltage or current. The proportional solenoid is controlled by a relatively high current such as a rectified mains voltage. A control circuit ensures that the coil of the proportional solenoid is not overloaded. Particularly, it ensures that a maximum current value is not exceeded. In this way, the mains supply required in prior art devices may be eliminated.

20 Claims, 14 Drawing Sheets

CONTROL OF A PROPORTIONAL VALVE USING MAINS VOLTAGE

This is a continuation of application Ser. No. 8/7,911, filed on Jan. 22, 1993, which was abandoned upon the filing hereof.

FIELD OF THE INVENTION

The present invention relates to a control circuit for solenoids and in particular to a control circuit for one or several solenoids of a valve, particularly a proportional valve. Specifically, the invention relates to a control circuit of a proportional directional control valve.

BACKGROUND OF THE INVENTION

Proportional directional control valves are widely used in applications and provide in principle the same function as servo valves. Proportional directional control valves, however, do not have high precision and require more input power (10–100 W) but are in return cheaper and more robust. Usually the solenoid(s) of a proportional valve is supplied usually by a pulse width modulated open loop control amplifier being fed by a mains supply having usually an output voltage of 24 V. Since the porportional solenoid has an inductivity due to its coil, the current in the solenoid only rises slowly and thus in turn the operation of the associated valve is slow. Particularly with proportional solenoids having a low resistance this further results in a high load of the mains supply.

SUMMARY OF THE INVENTION

The present invention provides the proportional solenoid to be directly supplied with and actuated by the (rectified) mains voltage, i.e. a DC voltage on the order of 250 V. The advantage thereof resides particularly in that the proportional solenoid responds more quickly or more promptly. Thus the natural or resonance frequency of the proportional solenoid can be increased from originally 100 Hz to 400 Hz. Apart from that the 24 V mains supply can be eliminated.

Thus, while it can take for example up to 5 msec to actuate the valve when operating a proportional solenoid at 24 V, a much shorter response time such as in the area of 1.25 msec is achieved by applying the rectified and substantially higher mains voltage directly to the solenoid.

The proportional solenoid directly actuated by the mains voltage may preferably be the same proportional solenoid which is otherwise operated at the lower DC voltages such as usually 24 V. The invention provides the current flowing through the coil of the proportional solenoid always to be less than a maximally allowable value such as 3 A. This is achieved by applying the relatively high (rectified) mains voltage for an accordingly short time and by switching it off whenever the load limit of the proportional solenoid is reached.

BRIEF DESCRIPTION OF THE DRAWINGS

Other features and advantages of the present invention will become apparent to those skilled in the art to which the present invention relates from a reading of the following detailed description of preferred embodiments with reference to the accompanying drawings, in which.

DETAILED DESCRIPTION OF PREFERRED EMBODIMENTS

Figure 2:
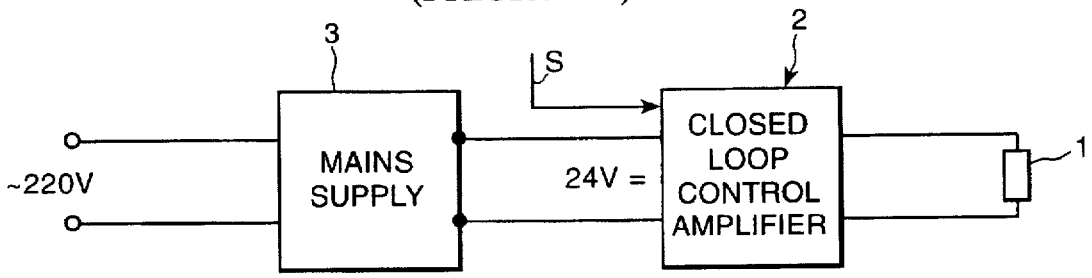
Fig. 2 (PRIOR ART)
FIG. 2 shows a circuit diagram of a conventional control circuit of a proportional solenoid.

FIG. 2 illustrates a control circuit 2 for a solenoid 1, in particular a proportional solenoid of a proportional directional control valve (not shown). The control circuit 2 is supplied with a signal value S. In response to this signal value S the armature of the solenoid 1 displaces accordingly the spool of a valve such as a proportional directional control valve. The control circuit 2 is supplied by a mains supply 3 with a DC voltage of 24 V which serves as the supply voltage for the components of the control circuit 2 as well as to be applied to the solenoid 1. The mains supply 3 is connected to a mains voltage such as 220 V.

Figure 1:
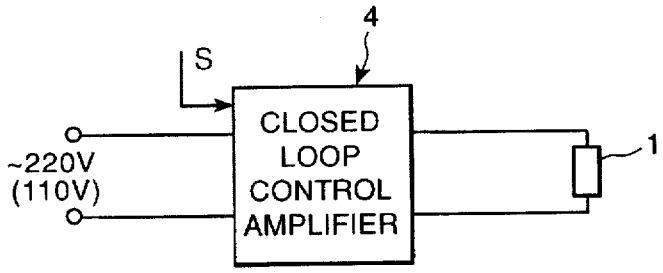
FIG. 1 shows a circuit diagram of a control circuit of a proportional solenoid in accordance with the present invention.

FIG. 1 illustrates the principle of the invention. Here the proportional solenoid 1 is driven by a control circuit 4 such as a closed loop control amplifier such that the displacement of the valve spool of the solenoid 1 is effected in response to the applied signal value or desired value S, wherein the mains voltage of 220 V (or 110 V) may be sort of directly applied to the solenoid. Specifically, the rectified mains voltage is applied to the solenoid and in the control circuit 4 there are circuits provided which render an overload of the solenoid 1 impossible.

Before explaining the more specific embodiments (FIGS. 7 and 8) of the control circuit according to the invention as shown in FIG. 1, the prior art is discussed with reference to FIGS. 3 to 6.

Figure 3:
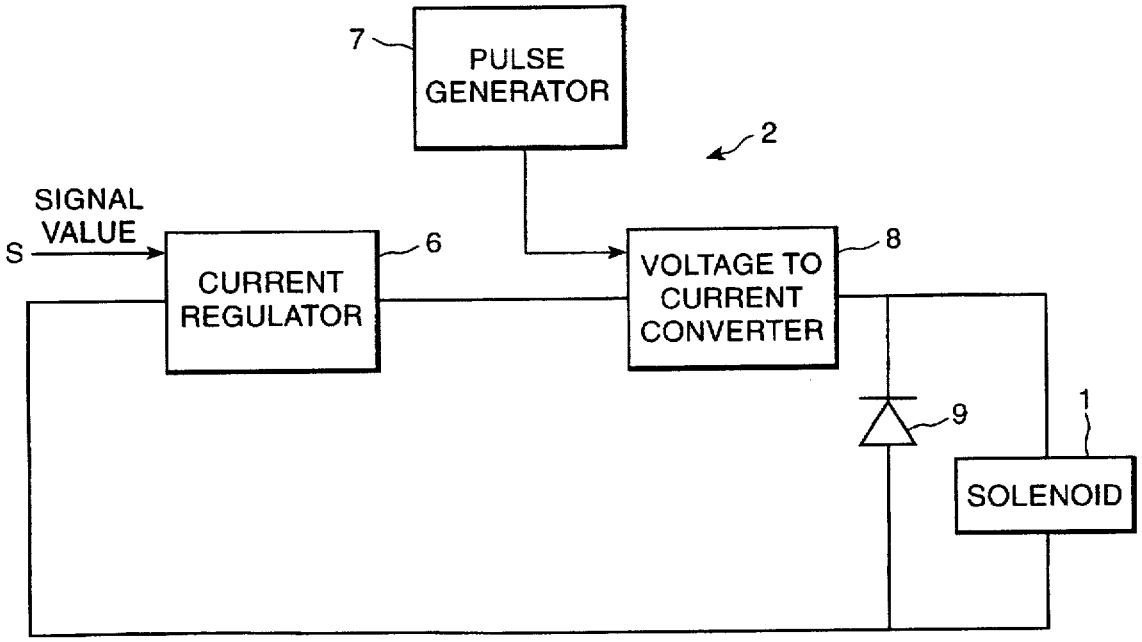
Fig. 3 (PRIOR ART)
FIG. 3 shows a circuit diagram illustrating a pulse width modulated output stage as can be utilized in the prior art and in principle also in the present invention.
Figure 4:
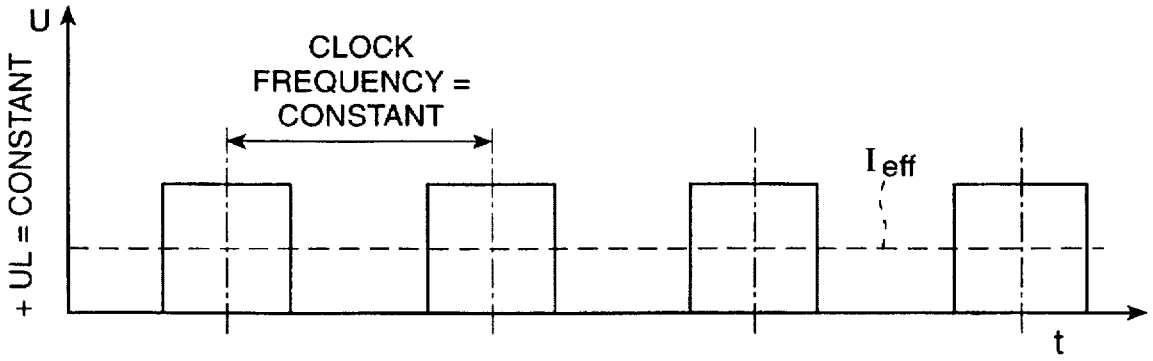
Fig. 4 (PRIOR ART)
FIGS. 4 and 5 show an illustration of the function of the circuit of FIG. 3.
Figure 5:
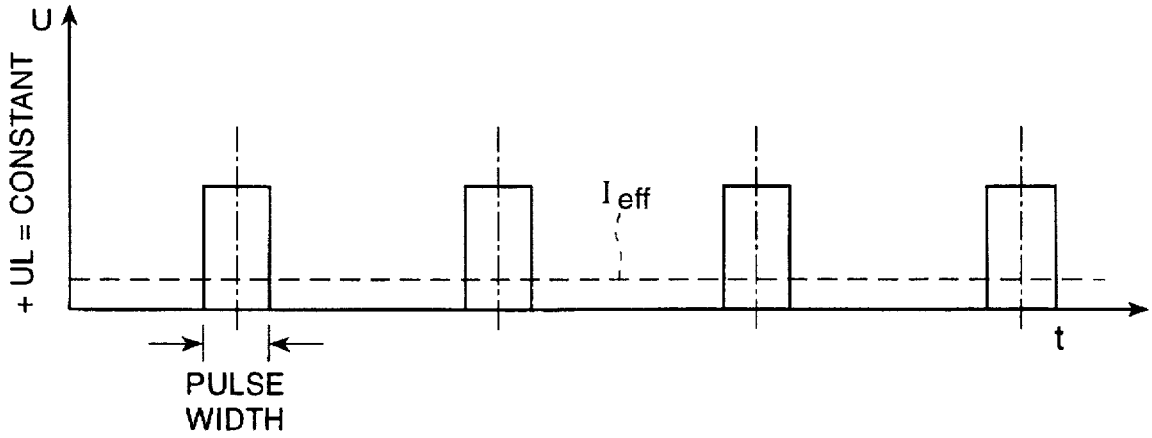
Fig. 5 (PRIOR ART)

From "The Hydraulic Trainer", Vol. 2, 1986, edited by Mannesmann Rexroth of Lohr/Germany, it is known to utilize a pulse width modulated output stage as shown in FIG. 3. In FIG. 3, solenoid 1 can be recognized and it can be seen that control circuit 2 comprises a current regulator 6, a pulse generator or clock 7, a voltage-to current converter 8 and a diode 9 in parallel with the solenoid 1. The function of the control circuit of FIG. 3 can readily be gathered from FIGS. 4 and 5 which will now be described. FIG. 4 discloses the output for a fully "on" situation in FIG. 3 and FIG. 5 discloses the output for a partly "on" situation in FIG. 3. The frequency of the pulses shown in FIGS. 4 and 5 is determined by the pulse generator 7 of FIG. 3 dependent on the type of valve. The effective current which will flow in the solenoid 1 depends on the on/off time ratio of the output power transistor of the converter 8. Thus, the pulsed voltage shown in FIGS. 4 and 5, respectively, will produce a certain current $I_{feff}$ at the solenoid.

Figure 6A:
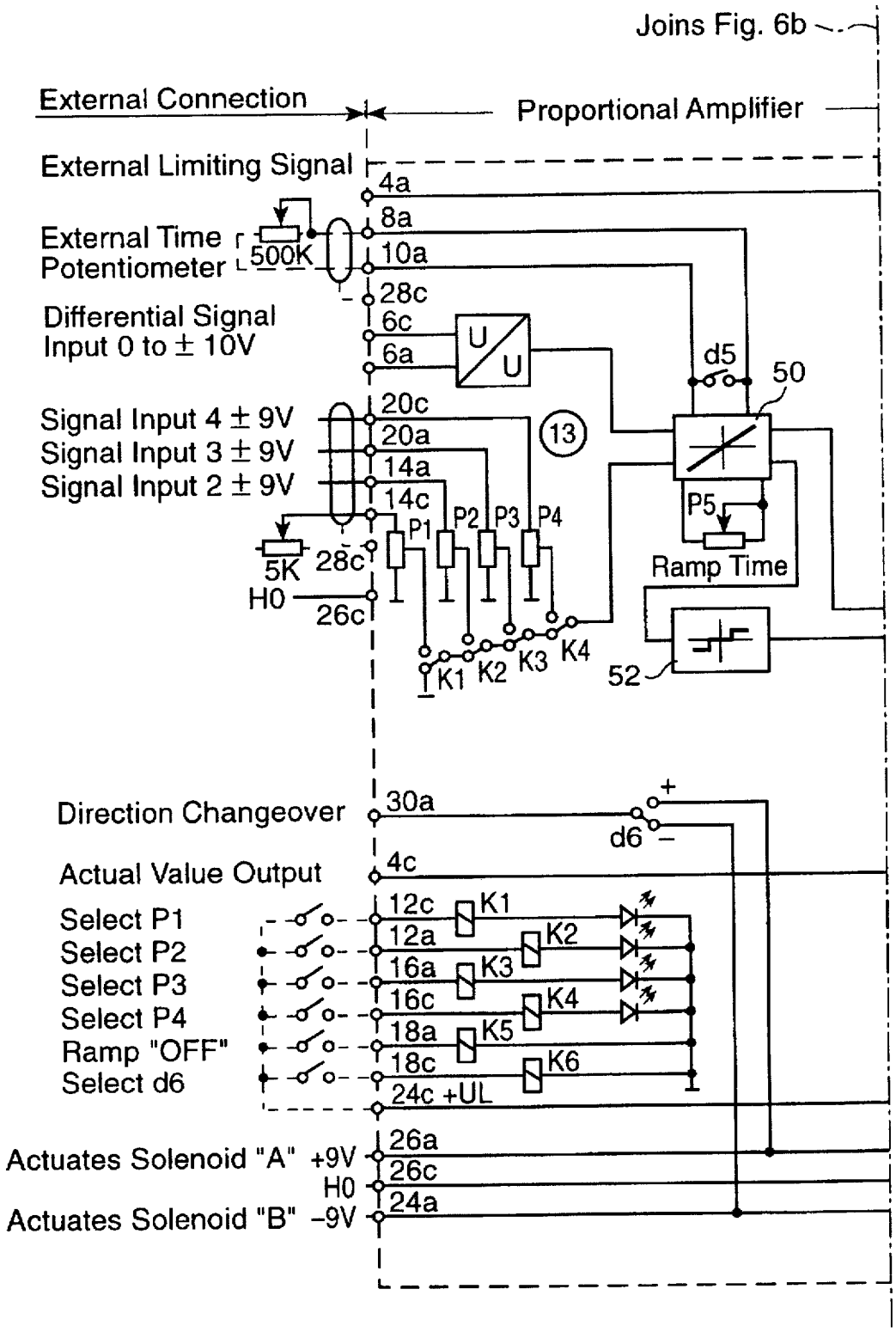
Fig. 6a (PRIOR ART)
FIG. 6 shows a circuit diagram of a specific control circuit for a proportional solenoid of the prior art as shown generally in FIG. 2.
Figure 6B:
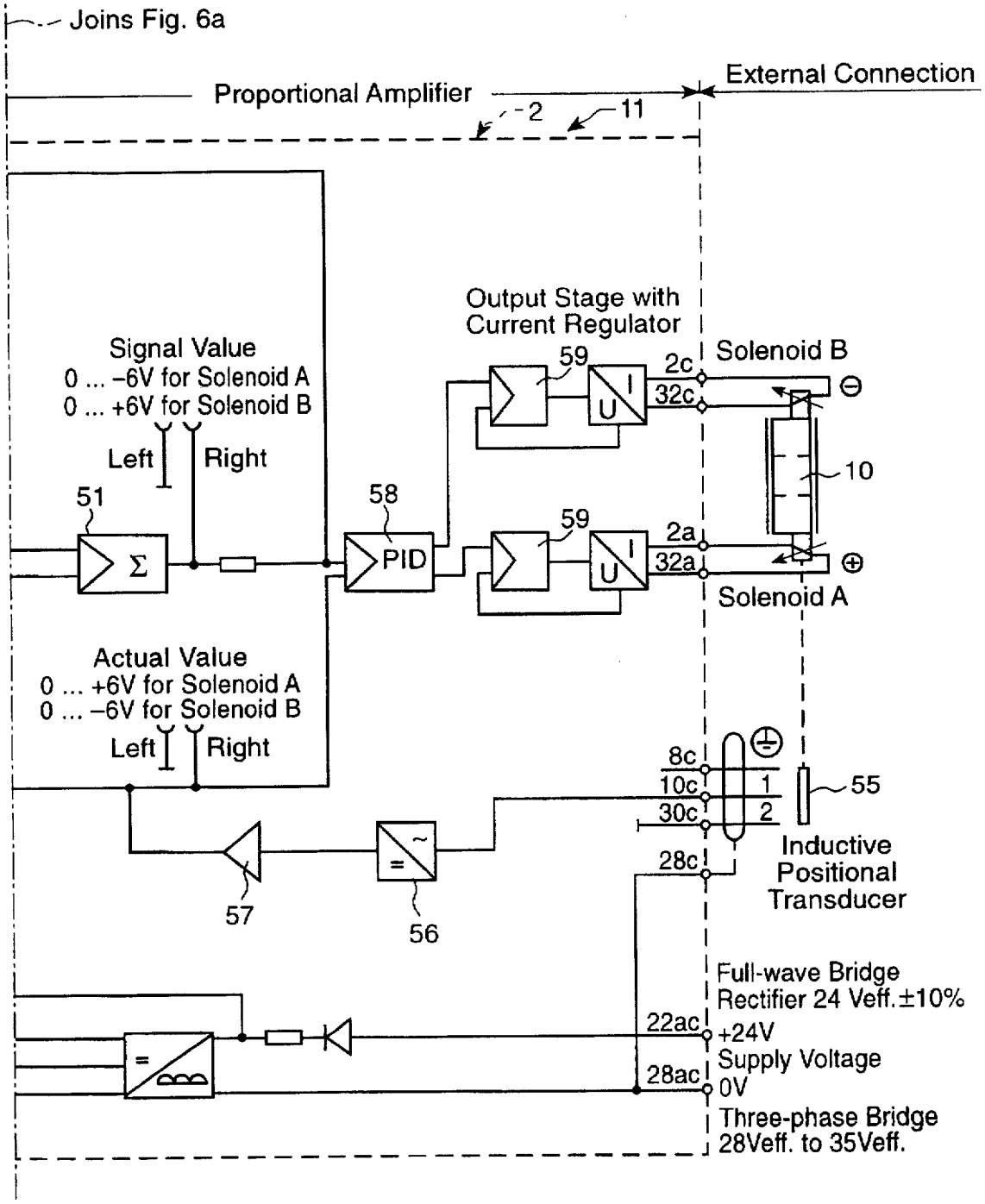
Fig. 6b (PRIOR ART)

FIG. 6 (see also page D19) shows a proportional directional control valve 10 which can be controlled by means of two solenoids A and B. The control circuit or proportional amplifier 2 is in this case located on a circuit card (amplifier board). The function of the proportional amplifier 2 is as follows.

The supply voltage UV for the proportional amplifier board 11 is generated from a mains of 220 V/380 V via transformers with rectifier (not shown).

The supply voltage is applied at the terminals 22*ac* (+) and 28*ac* (0V). This supply voltage UV is smoothed on the amplifier board 11 and is used to produce a stabilized voltage of ±9 V.

The stabilized voltage of ±9 V is used a) for the supply of the external potentiometers or the internal potentiometers, available at 26*a* +9 V and at 24*a* −9 V.

b) for the supply of the internal operational amplifiers.

The amplifier board is equipped with 4 potentiometers for signal value setting P1 to P4 (13). In order to set a signal value voltage, the 4 signal inputs, terminals 20*c*, 20*a*, 14*a*, 14*c*, must be connected to the stabilized voltage +9 V terminal 26*a* or −9 V terminal 24*a*. The solenoid A is active if the signal inputs are connected to +9 V supply. The solenoid A is connected to the terminals 2*a* and 32*a*. The solenoid B is active if the signal inputs are connected to −9 V supply. The solenoid B is connected to the terminals 2*c* and 32*c*. The set signal value voltages (desired value voltages) P1 . . . P4 are selected via the relays 12. They are applied to terminals 12*c*, 12*a*, 16*a*, 16*c*. The selection voltage for the relays can be tapped off at terminal 24*c* and routed via potential-free contacts to the relay inputs 12*c*, 12*a*, 16*a*, 16*c*. A stepped signal is generated at the input of the ramp generator 50 when the set value potentiometers P1 to P4 are selected. The ramp generator 50 generates a gradually increasing output signal from a stepped-up input signal. The rise time (gradient) of the output signal can be adjusted with the potentiometer P5 (ramp time). The specified ramp time of max. 5 sec. can only be reached over the complete voltage range (from 0 V to ±6 V, measured at the signal value test sockets). A signal value voltage of ±9 V at the input produces a voltage of ±6 V at the signal value test points. The ramp time is correspondingly shortened if a smaller signal value than ±9 V is connected to the input of the ramp generator 50. The output signal of the ramp generator 50 is routed to the summator 51 and the step function generator 52. The step function generator 52 generates at its output a step function which is added in the summator 51 to the output signal of the ramp generator 50. The step function is required to move through the zero overlap of the valve quickly.

This step is effective in the case of low signal value voltages (less than 100 mV). The step function generator 52 produces a constant signal if the signal value voltage increases to a higher value.

The output signal of the summator 51 is fed to the PID controller 58 in the form of a signal value or desired value.

The oscillator 54 converts a DC signal into an AC voltage (frequency 2.5 kHz). This signal acts on the inductive positional transducer 55.

The positional transducer 55 varies the AC voltage depending on the position of the value spool. The AC signal is converted back to a DC signal by the demodulator 56.

The matching amplifier 57 amplifies the DC voltage to a maximum voltage of ±6 V (max. spool stroke). The output signal of the matching amplifier 57 is fed to the PID controller 58 as an actual value.

The PID controller 58 is optimized for the type of valve. It produces a signal dependent on the difference between the signal value (desired value) and the actual value. This output signal controls the output stage 59 of the amplifier.

Figure 7:
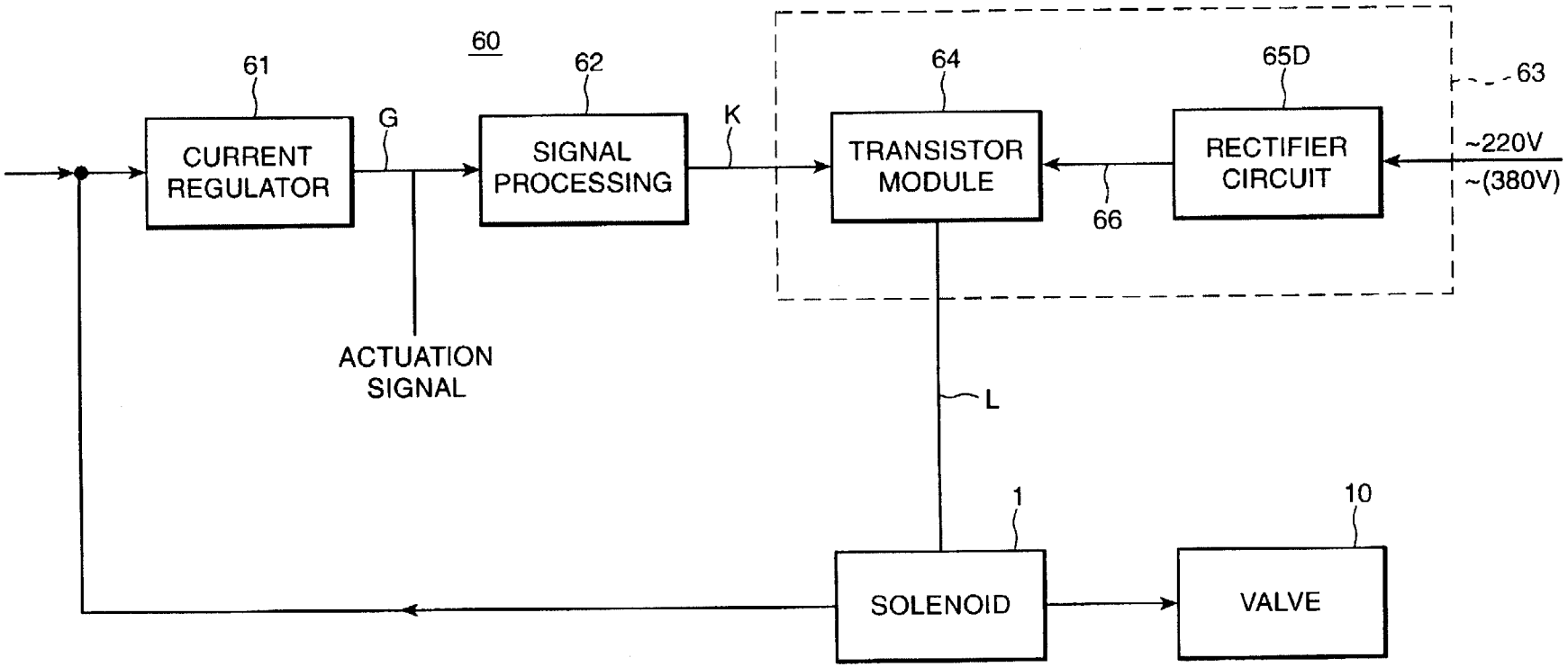
FIG. 7 is a schematic circuit diagram showing in principle a control circuit for a proportional solenoid in accordance with the present invention.

FIG. 7 shows a control circuit 60 for a proportional solenoid 1 in accordance with the present invention. The solenoid 1 actuates a proportional valve 10 by means of its pin. The control circuit comprises a current regulator 61 providing an actuation signal G such as a voltage signal to a signal processing circuit 62. The output signal of the signal processing circuit 62 is designated K and is fed to a mains voltage circuit 63 to cause the mains voltage circuit 63 to apply an output signal L corresponding to the output signal K to the proportional solenoid 1. According to the invention the output signal L is directly generated from the mains voltage, preferably by rectification, and is applied to the solenoid also in the order of magnitude of the mains voltage. Preferably, the signal processing circuit is designed such that the available rectified mains voltage is applied only for a short time to the solenoid 1 whereby the current flowing in the solenoid 1 is held at a safe or admissible level. This is easily achieved because when the voltage is applied to the solenoid 1 the current rises following an e-function and has thus to be switched off when the load becomes excessive. See also FIGS. 11 and 12, wherein this process is illustrated in comparison with the prior art.

As an example it may be mentioned that a conventional solenoid 1 may not be loaded with more than 3 A. The signal processing circuit 62 is then designed such that the current in the coil of the solenoid 1 never rises above 3 A or 3.5 A. Just before reaching the limit the voltage is simply switched off.

By applying a relatively high voltage of about 220 V as compared to the usual 24 V, a substantially quicker response of the solenoid 1 is achieved. Further, the natural or resonance frequency of the solenoid valve can thus be raised from conventionally 100 Hz to about 400 Hz.

As is common with closed loop controls, the current flowing in the solenoid 1 is continuously measured and the corresponding actual value D is compared against a signal value. As soon as a difference occurs between the two, caused by a disturbance, an approriate change is made which brings the controlled variable and thus the actual signal back into accordance with the signal value or desired value. The current controller or regulator 61 functions to generate a controlling variable in the form of an controlling signal G.

The mains voltage circuit 63 preferably comprises a transistor module 64 and a rectifier circuit 650. A DC voltage such as 300 V is applied to the transistor module via line means 66. This relatively high DC voltage as compared to 24 V is preferably pulse width modulated and applied via the transistor module 64 such that the allowable current load of the solenoid 1 is not exceeded. See FIGS. 11 and 12.

Figure 8:
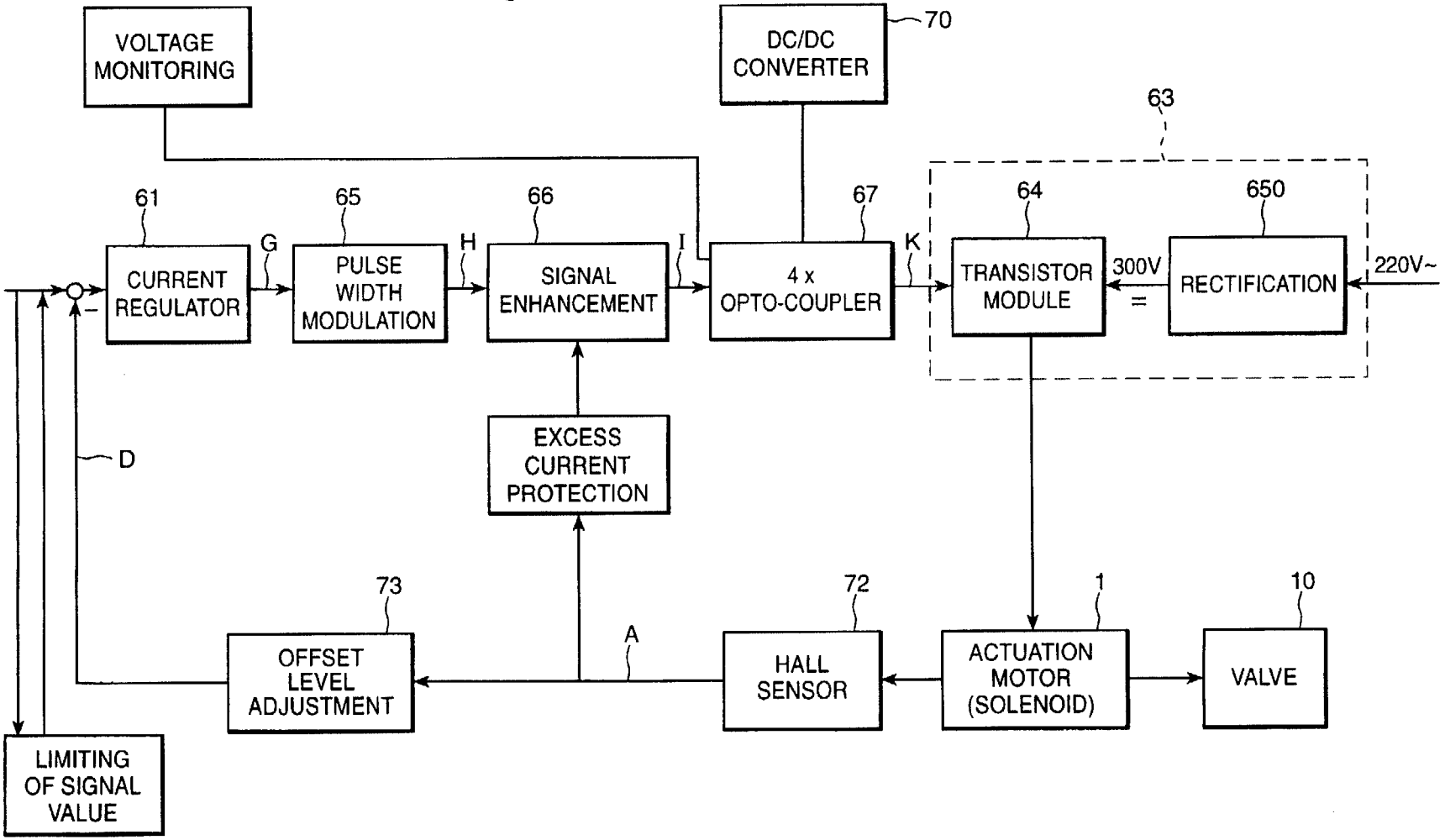
FIG. 8 shows a preferred embodiment of a control circuit as shown in FIG. 7.

FIG. 8 shows a preferred version of the embodiment of FIG. 7. Specifically it is illustrated in FIG. 8 how the signal processing circuit 60 may preferably be designed. Further it is shown in FIG. 8 in detail how the actual signal D is preferably determined.

First, reference is made to the signal processing circuit 60.

The controlling signal G provided by the current regulator 61 is preferably present as a voltage and is fed to a pulse width modulation circuit 65. In the pulse width modulation circuit 65 the information concerning the controlling signal is coded in a way as has been explained in connection with FIGS. 4 and 5. Accordingly, the pulse width modulation circuit 65 outputs a pulse width modulated controlling or actuating signal H. In a signal enhancement circuit 66 the signal H is converted into an output signal I consisting of four pulse width modulated controlling signals. The four pulse width modulated controlling signals are referenced U+, U−, V+, and V− in FIG. 9 described below. The four pulse width modulated controlling signals are converted via an optocoupler 67 into an output signal K which itself is comprised of four pulse width modulated control signals. The optocoupler circuit 67 provides the electrical separation of the Signals I and K. Signal K switches transistor module 64 in response to the information contained in its four pulse width modulated signals, i.e. in response to the magnitude of the controlling signal.

The optocoupler circuit 67 further serves to superimpose a clock or modulation frequency on the signal K, or its four pulse width modulated individual signals, respectively, by means of a push-pull generation circuit 69 (shown in FIG. 9) and a transmitter circuit 70.

For the electrically separated determination of the actual signal (preferably the actual current signal) a Hall sensor is connected to the solenoid 1. The output signal A of the Hall sensor is directed to an offset and closed loop control adjustment circuit 73. The output signal D of the offset and closed loop control adjustment circuit fluctuates then around a zero reference point such as between 0 V and ±2 V. Alternatively, an isolating amplifier may be used in place of the Hall effect sensor.

Figure 9:
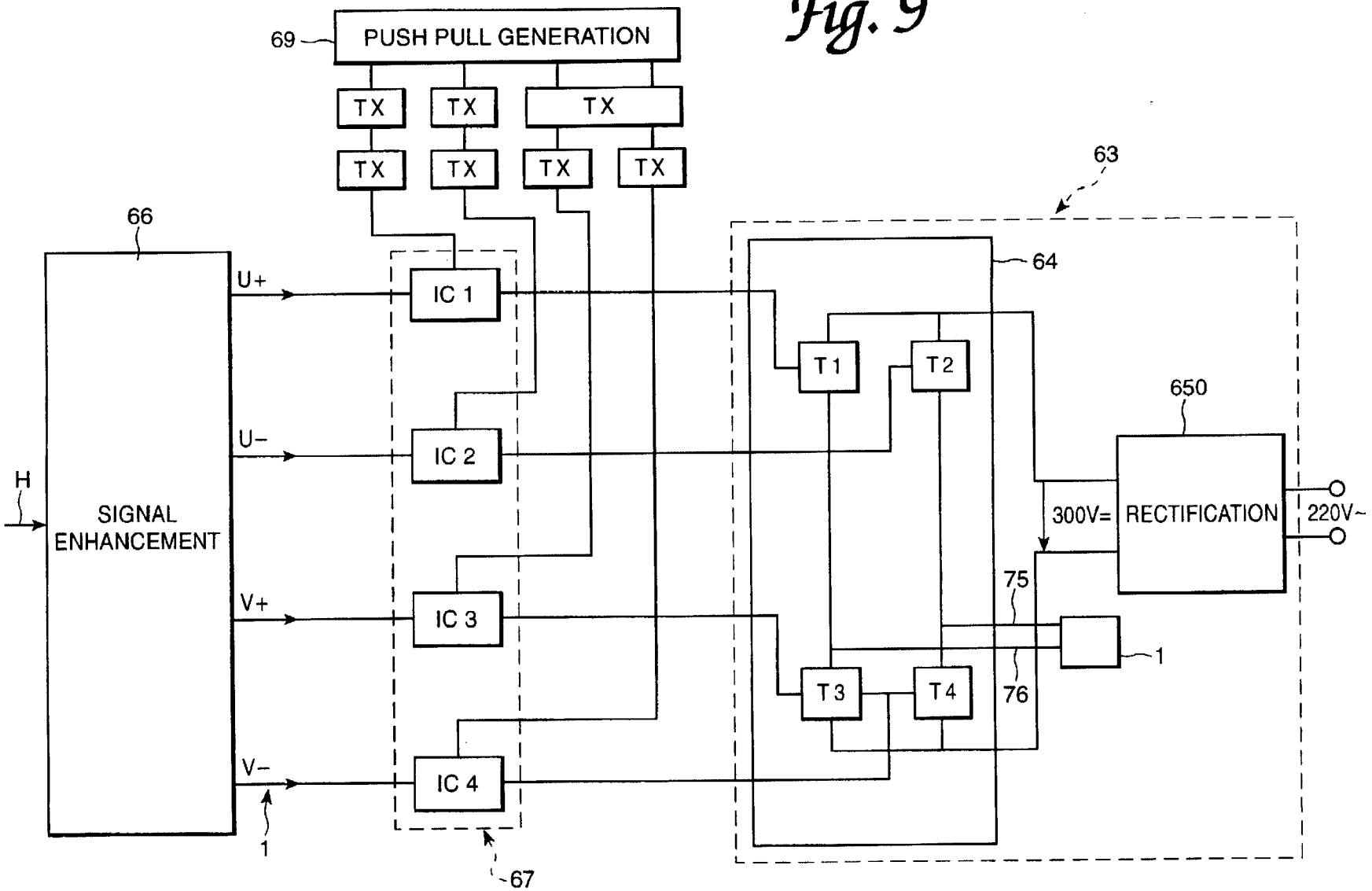
FIG. 9 shows a specific embodiment of a part of FIG. 8.

FIG. 9 illustrates in detail the mains voltage rectification circuit 650, the optocoupler circuit 67 and the signal enhancement circuit 66. It can be seen that the four output signals forming signal I are fed to respective optocouplers IC1, IC2, IC3, and IC4. The push-pull generator 69 is connected to the individual optocouplers via transmitters. The outputs of the optocouplers IC1 to IC4 are connected to the control inputs of four transistors T1, T2, T3, and T4. In response to the four pulse width modulated signals, preferably being current signals applied by the optocouplers IC1, IC2, IC3, and IC4, the transistors T1 to T4 are switched such that the transistors energize the solenoid 1 via output lines 75, 76 with a voltage, preferably a DC voltage on the order of approx. 300 V.

Figure 10A:
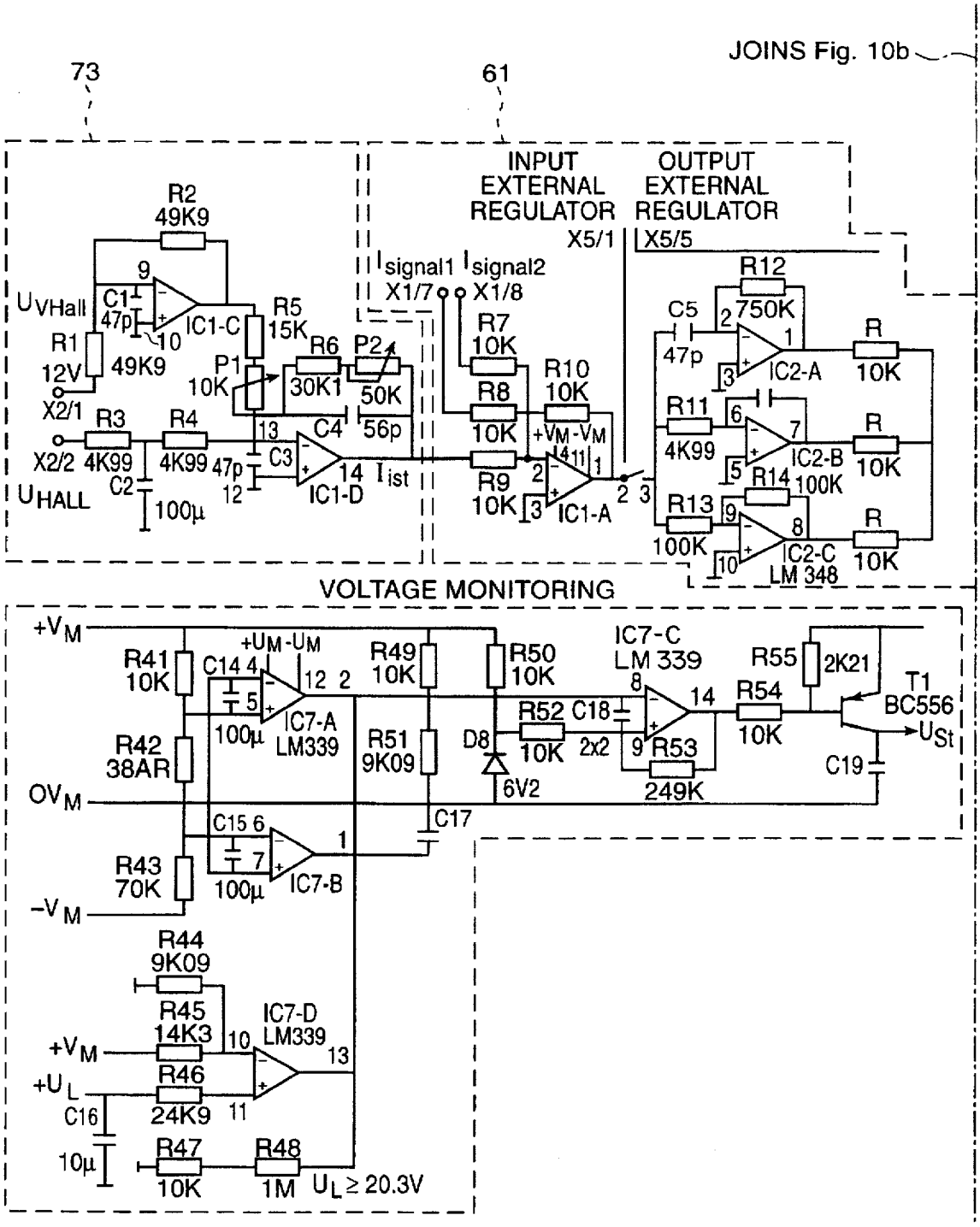
FIGS. 10*a*–10*f* show a specific preferred embodiment of the circuit of FIG. 7.

FIGS. 10*a*–10*f* show circuit diagrams illustrating details of the circuits shown in FIGS. 8 and 9. A detailed description of these circuits is not considered necessary since all symbols used therein are conventional and are readily understood by a person skilled in the art. The upper part of FIG. 10*a* shows a circuit which is connected to the circuit shown in FIG. 10*b*, i.e., the signal enhancement circuit 66 of FIG. 8. In the lower portion of FIG. 10*a*, a control voltage monitoring circuit is shown which supplies a voltage $U_{st}$ in FIG. 10*d*.

Figure 10B:
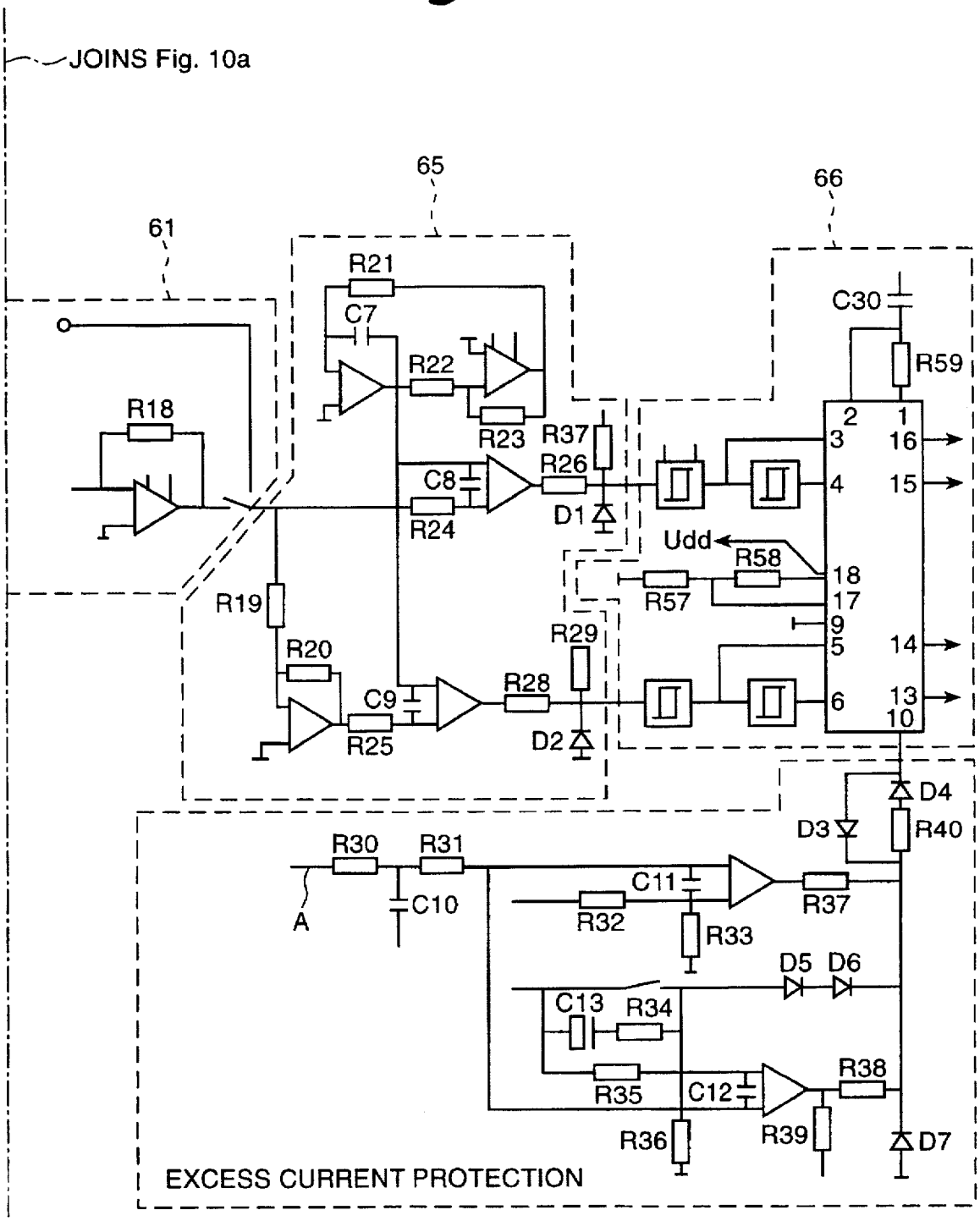
Figure 10C:
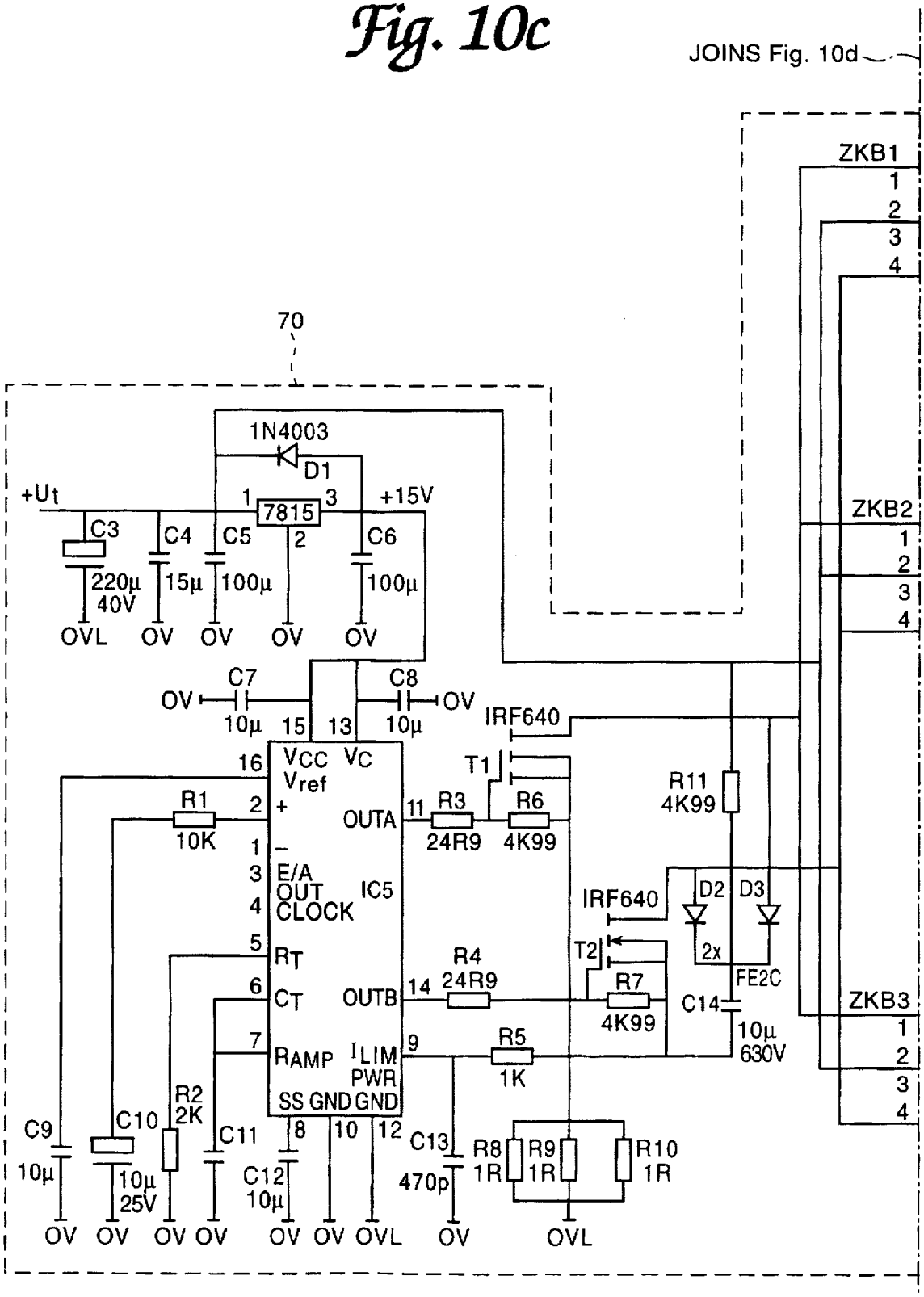
Figure 10D:
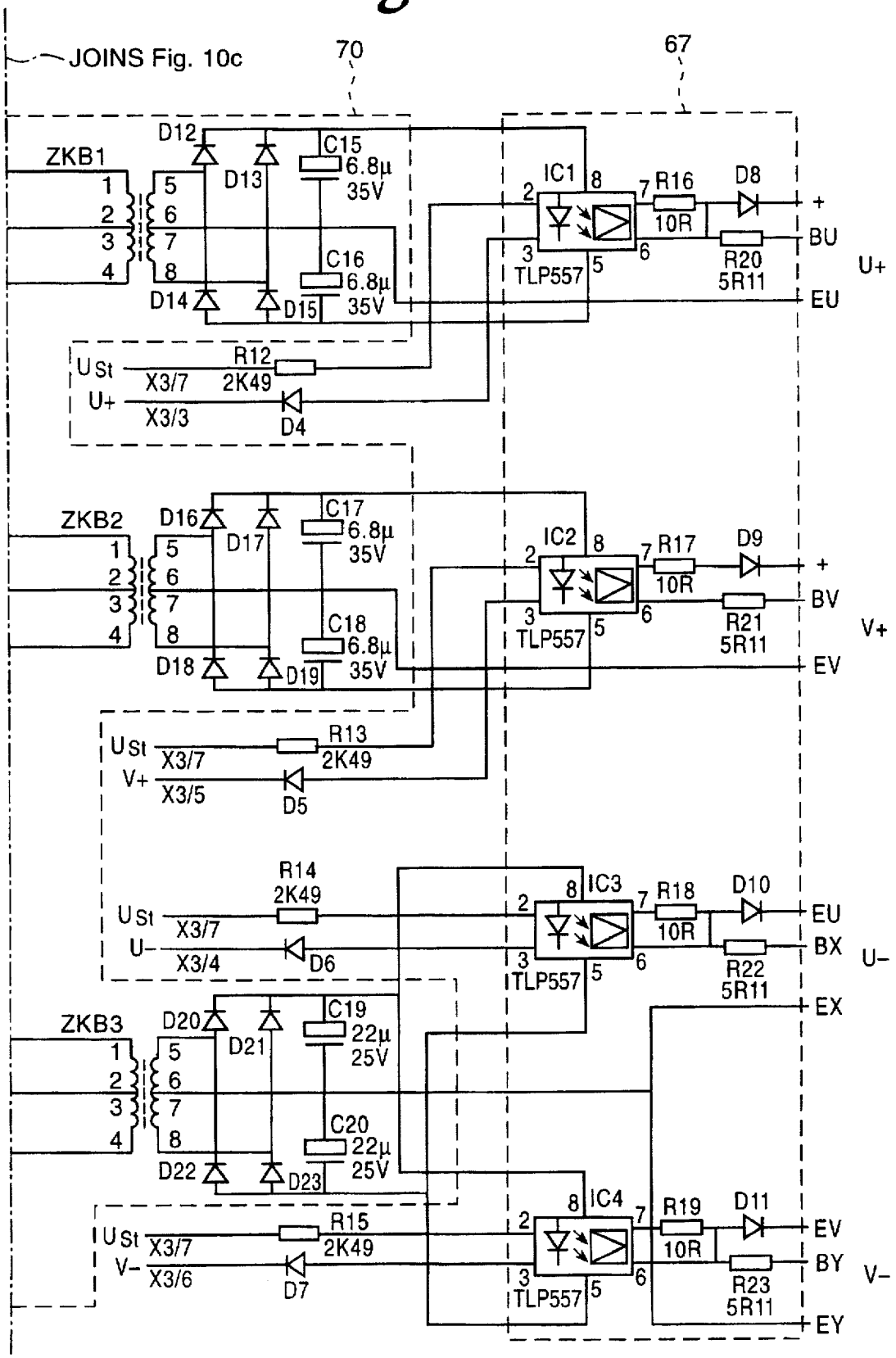
Figure 10E:
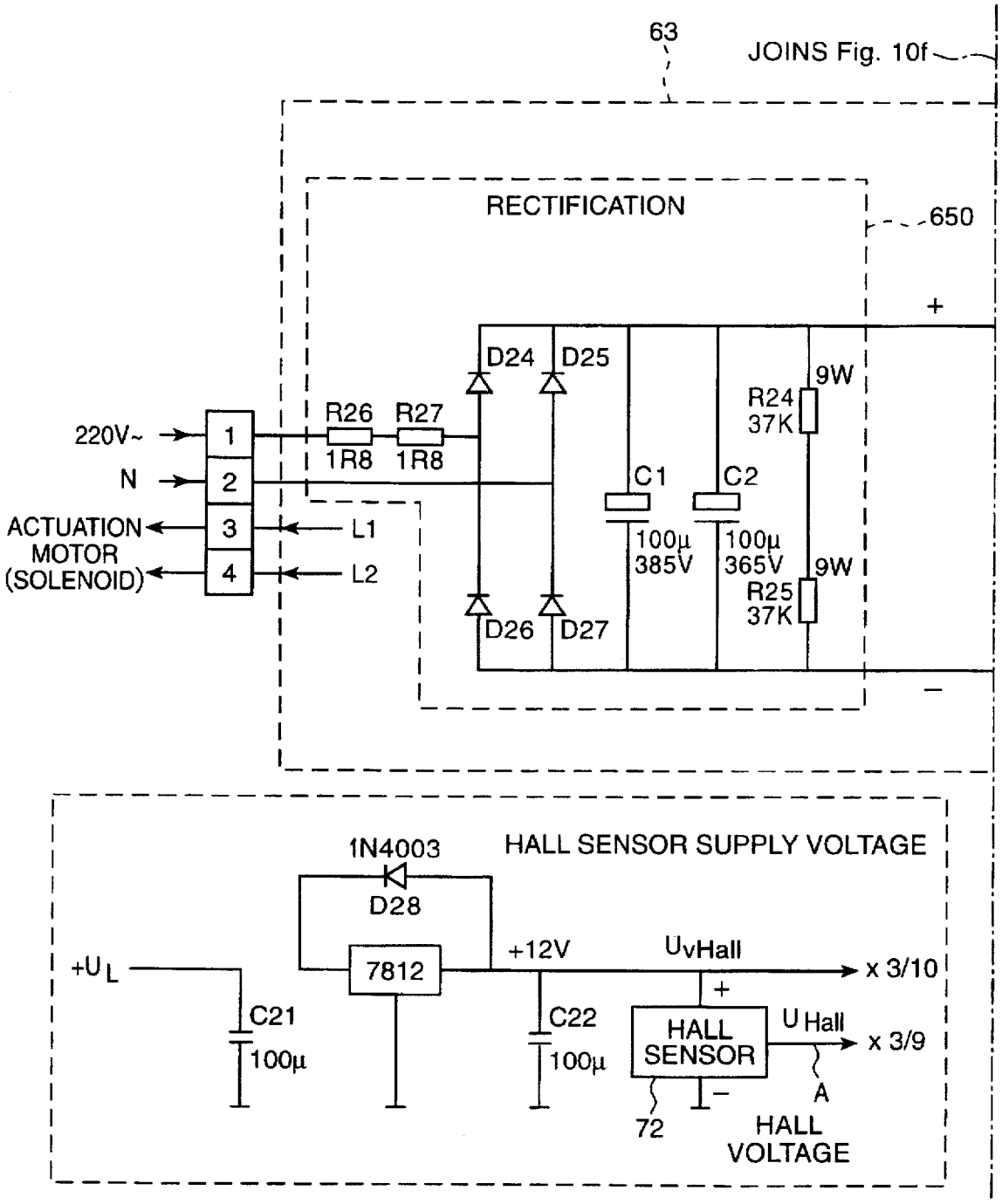
Figure 10F:
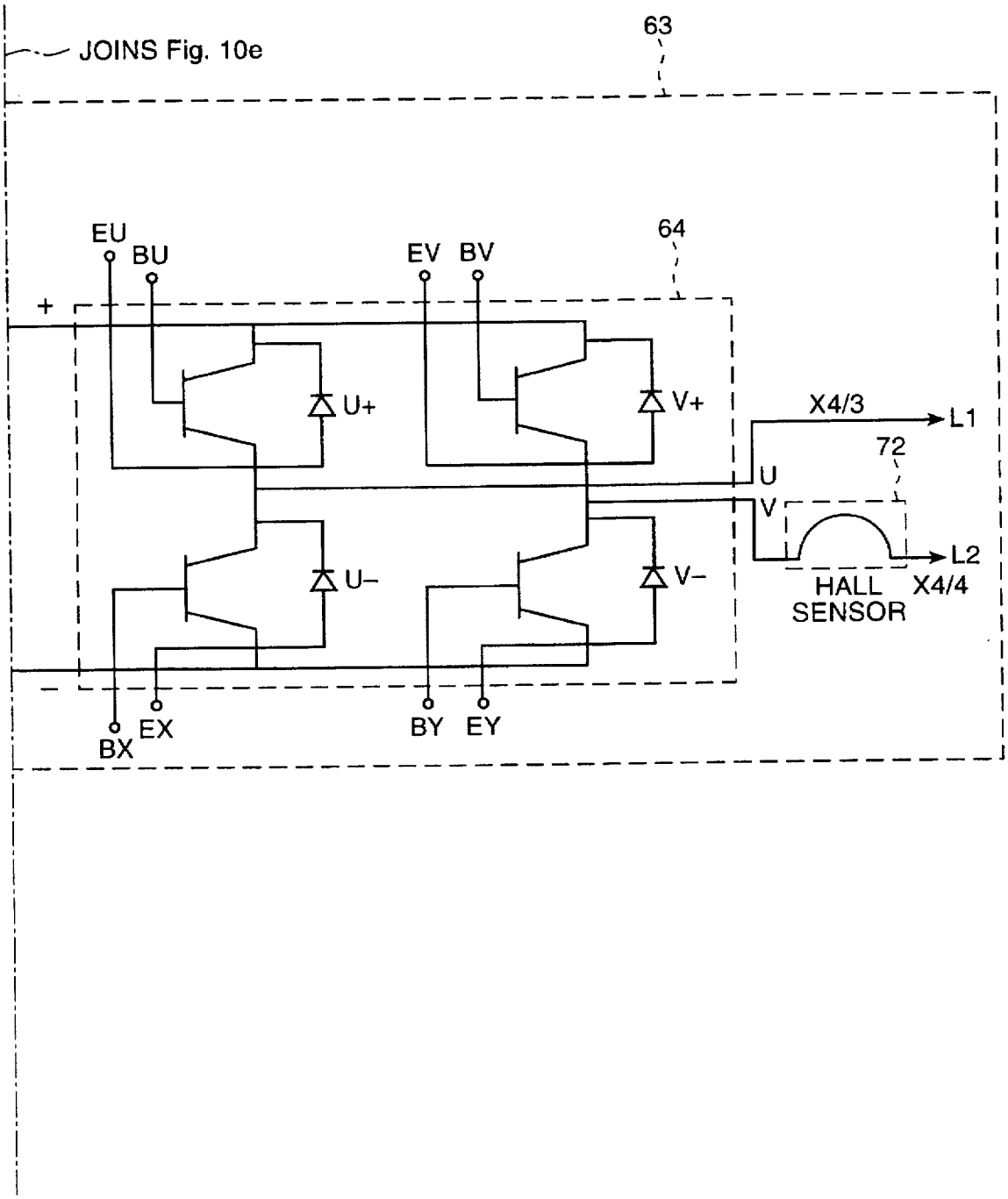

FIG. 10*b* corresponds, as mentioned, to the signal enhancement circuit shown in FIG. 8, with the lower part of FIG. 10*b* disclosing the excess current protection circuit. The respective terminals 13, 14, 15 and 16 of FIG. 10*b* which are adapted to supply voltages V−, V+, U−, and V+ are connected to the respective terminals referred to by U−, V+, U− and U+ in FIG. 10*d*. FIG. 10*c* is connected with its three groups of outputs to the respectively designated inputs of three transformers ZKB1–3, respectively, in FIG. 10*d*. The module of FIG. 10*d* is connected with its right hand output terminals to the respective input terminals of a part of the transistor module shown in FIG. 10*f*. FIG. 10*e* discloses the rectification circuit referred to by 650 in FIG. 8. The rectification circuit of FIG. 10*e* is connected to the left hand side inputs of the circuits of FIG. 10*f*. The lower portion of FIG. 10*e* only shows the generation of the supply voltage for the Hall sensor 72 of FIG. 8.

Figure 11:
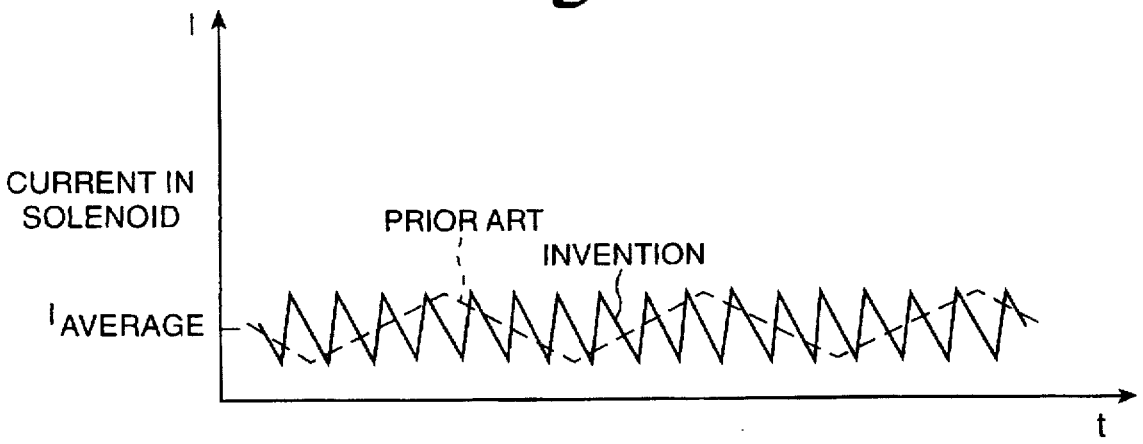
FIGS. 11 and 12 are graphical representations of the functions according to the invention and according to the prior art.
Figure 12:
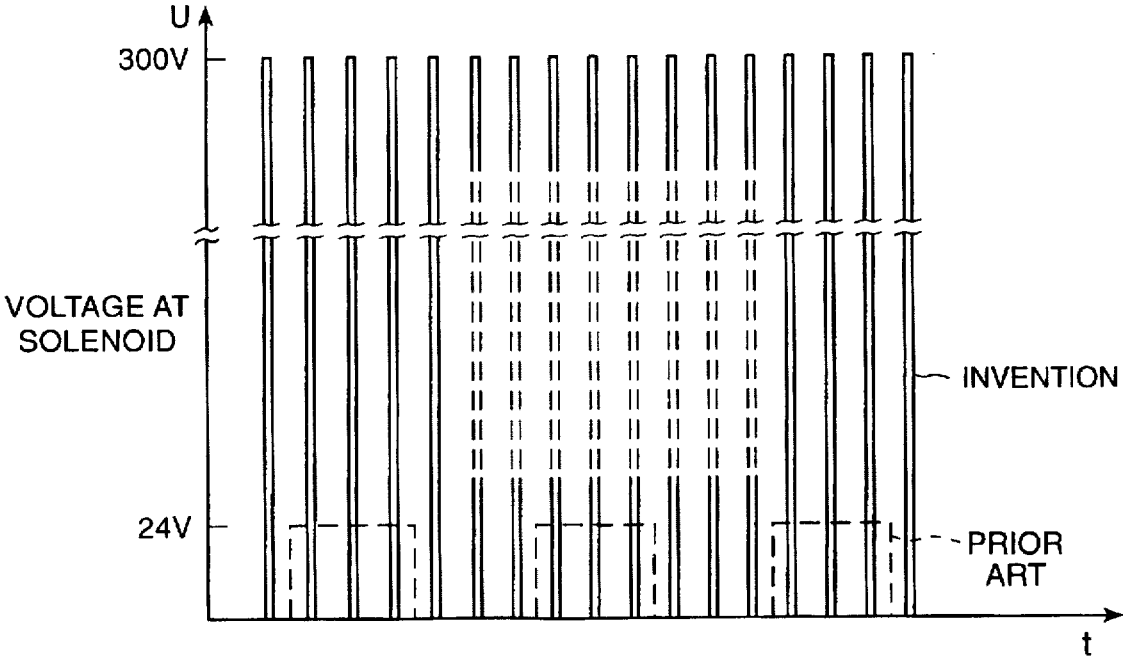

FIGS. 11 and 12 illustrate differences between the present invention and the prior art. The average current flow in the solenoid according to the prior art (dashed line) slowly increases to a peak value because of the relatively low pulsed voltage supplied to the solenoid. In accordance with the invention (solid line), due to the higher pulsed voltage a faster increase of the average current in the solenoid is achieved with the consequence of obtaining a faster actuation of the solenoid. FIG. 12 discloses parallel to what is shown in FIG. 11 that for the invention, higher voltages are applied to the solenoid which also leads to higher currents i the solenoid but of shorter duration with the consequence that a quick response of the solenoid is obtained.

We claim:

1. A proportional valve comprising:

a valve;

valve actuation detection means for detecting an actuation of said valve and for generating a valve actuation signal representative thereof at all times during operation of said proportional valve;

a solenoid actuating said valve, said solenoid including a coil;

a mains voltage supply generating electrical energy from a rectified mains voltage, said electrical energy being at least an order of magnitude greater than a maximum level acceptable to said coil; and control circuit means, powered by said mains voltage supply, for receiving said valve actuation signal and a reference signal for supplying to said mains voltage supply a controlling signal based on a difference between said valve actuation signal and said reference signal, said controlling signal causing said mains voltage supply to output said electrical energy comprising pulses of said electrical energy to said coil of said solenoid, and said control circuit means controlling application of said controlling signal so as to ensure that said coil of said solenoid is not overloaded by said electrical energy and that a maximum current value is not exceeded.

2. A proportional valve as set forth in claim 1, wherein said control circuit means comprises:

current controller means connected to said solenoid of said valve for providing a controlling signal to signal processing means for causing said mains voltage supply to apply said rectified mains voltage to said solenoid for a period of time corresponding to said controlling signal supplied from said current controller means.

3. A proportional valve as set forth in claim 1, wherein said mains voltage supply comprises:

a rectification circuit providing said rectified mains voltage directly to said solenoid for desired periods of time; and a transistor module controlled by a signal processing circuit.

4. A proportional valve as set forth in claim 1, further comprising:

a signal processing circuit including:

pulse width modulation means for generating a pulse width modulated controlling signal controlling said mains voltage supply.

5. A proportional valve as set forth in claim 4, wherein said control circuit means comprises:

a transistor module comprising four transistors; and a signal enhancement circuit for generating four pulse width modulated signals from said pulse width modulated controlling signal for controlling said transistor module.

6. A proportional valve as set forth in claim 5, wherein said control circuit means comprises:

optocoupler means for providing an electrically isolated transmission of signals between said signal enhancement circuit and said transistor module.

7. A proportional valve as set forth in claim 6, wherein:

said optocoupler means is connected to push-pull transmission means for electrically isolated transmission of control power.

8. A proportional valve as set forth in claim 1, further comprising:

a Hall sensor circuit connected to said solenoid to generate said valve actuation signal.

9. A proportional valve as set forth in claim 8, wherein:

said Hall sensor circuit is followed by an offset and closed loop control adjustment circuit for providing a signal in a range fluctuating around a zero reference point.

10. A proportional valve as set forth in claim 1, further comprising:

an isolating amplifier connected to said solenoid to generate said valve actuation signal.

11. A proportional valve comprising:

a valve;

a valve actuation detector to detect an actuation of said valve and to provide a valve actuation signal representative thereof at all times during operation of said proportional valve;

a solenoid actuating said valve, said solenoid including a coil;

a mains voltage supply which generates electrical energy from a rectified mains voltage, said electrical energy being at least an order of magnitude greater than a maximum level acceptable to said coil; and a control circuit powered by said mains voltage supply, said control circuit receiving said valve actuation signal and a reference signal and supplying a controlling signal to said mains voltage supply, said controlling signal being based on a difference between said valve actuation signal and said reference signal, said controlling signal causing said mains voltage supply to output said electrical energy to said coil of said solenoid, said control signal causing said mains voltage supply to provide said electrical energy to said coil as a series of pulses of said electrical energy, a duty cycle of said pulses being such that said coil is not overloaded and such that a maximum current value of said coil is not exceeded.

12. A proportional valve according to claim 11, wherein said control circuit comprises:

a current controller connected to said solenoid, said current controller providing a controlling signal to cause said mains voltage supply to apply said rectified mains voltage to said solenoid.

13. A proportional valve according to claim 11, wherein said mains voltage supply comprises:

a rectification circuit providing said rectified mains voltage directly to said solenoid for desired periods of time; and a transistor module controlled by a signal processing circuit.

14. A proportional valve according to claim 11, further comprising:

a pulse width modulator to generate a pulse width modulated controlling signal which controls said mains voltage supply.

15. A proportional valve according to claim 14, wherein said control circuit comprises:

a transistor module comprising four transistors; and a signal enhancement circuit to generate four pulse width modulated signals from said pulse width modulated controlling signal to control said transistor module.

16. A proportional valve according to claim 15, wherein said control circuit comprises:

an optocoupler to provide an electrically isolated transmission of signals between said signal enhancement circuit and said transistor module.

17. A proportional valve according to claim 16, wherein:

said optocoupler is connected to a push-pull transmitter to isolate electrically a transmission of control power.

18. A proportional valve according to claim 11, further comprising:

a Hall sensor circuit connected to said solenoid to generate said valve actuation signal.

19. A proportional valve according to claim 18, further comprising:

an offset and closed loop control adjustment circuit, following said Hall sensor circuit, to provide a signal in a range fluctuating around a zero reference point.

20. A proportional valve according to claim 11, further comprising:

an isolating amplifier connected to said solenoid to generate said valve actuation signal.

* * * * *